United States Patent [19]

McCarthy et al.

[11] 4,345,794

[45] Aug. 24, 1982

[54] PLACEMENT OF EXPLOSIVE FOR FORMING IN SITU OIL SHALE RETORT

[75] Inventors: Harry E. McCarthy; Gordon B. French, both of Golden, Colo.; Melvin A. Cook, Salt Lake City, Utah

[73] Assignee: Occidental Oil Shale, Inc., Grand Junction, Colo.

[21] Appl. No.: 205,872

[22] Filed: Nov. 10, 1980

[51] Int. Cl.[3] ..... E21C 41/10

[52] U.S. Cl. ..... 299/2; 102/312; 299/13

[58] Field of Search ..... 299/2, 13; 166/299; 102/311, 312

[56] References Cited

U.S. PATENT DOCUMENTS

| | | | |
|---|---|---|---|
| 3,677,342 | 7/1972 | Silverman | 166/247 |
| 3,771,600 | 11/1973 | Hill | 102/311 X |
| 4,043,597 | 8/1977 | French | 299/2 |
| 4,043,598 | 8/1977 | French | 299/2 |

FOREIGN PATENT DOCUMENTS

| | | | |
|---|---|---|---|
| 1012564 | 6/1977 | Canada | 299/13 |

OTHER PUBLICATIONS

L. C. Lang, "The Application of Spherical Charge Technology in Stope and Pillar Mining", *Engineering and Mining Journal,* May 1976, pp. 98–101.

*Primary Examiner*—Ernest R. Purser

*Attorney, Agent, or Firm*—Christie, Parker & Hale

[57] ABSTRACT

A subterranean formation containing oil shale is prepared for in situ retorting by initially excavating a plurality of vertically spaced apart voids within a retort site, leaving an intervening zone of unfragmented formation between an adjacent pair of such voids. The intervening zone has substantially parallel upper and lower horizontal free faces adjoining the voids. At least one pancake-shaped load of explosive is placed in the intervening zone. The pancake-shaped explosive load has faces which are substantially parallel to the upper and lower free faces, and the length of the axis of the explosive load is less than the radius of the load. The explosive load is detonated for explosively expanding formation toward the upper and lower free faces for forming an in situ retort containing a fragmented permeable mass of formation particles. In one embodiment, a plurality of such pancake-shaped explosive charges are placed at horizontally spaced apart locations at substantially the same level and approximately in the middle of the intervening zone, and the explosive charges are detonated in a single round of explosions for forming the fragmented mass.

41 Claims, 5 Drawing Figures

PLACEMENT OF EXPLOSIVE FOR FORMING IN SITU OIL SHALE RETORT

BACKGROUND

This invention relates to in situ recovery of shale oil, and more particularly, to techniques involving the excavation and explosive expansion of oil shale formation in preparation for forming an in situ oil shale retort.

The presence of large deposits of oil shale in the Rocky Mountain region of the United States has given rise to extensive efforts to develop methods for recovering shale oil from kerogen in the oil shale deposits. It should be noted that the term "oil shale" as used in the industry is in fact a misnomer; it is neither shale, nor does it contain oil. It is a sedimentary formation comprising marlstone deposit with layers containing an organic polymer called "kerogen", which upon heating in the absence of oxygen decomposes to produce liquid and gaseous products. It is the formation containing kerogen that is called "oil shale" herein, and the liquid hydrocarbon product is called "shale oil."

A number of methods have been proposed for processing oil shale which involve either first mining the kerogen-bearing shale and processing the shale on the ground surface, or processing the shale in situ. The latter approach is preferable from the standpoint of environmental impact.

The in situ recovery of liquid and gaseous products from oil shale deposits have been described in several patents, such as U.S. Pat. Nos. 3,661,423; 4,043,595; 4,043,596; 4,043,597; and 4,043,598 which are incorporated herein by this reference. These patents describe in situ recovery of liquid and gaseous hydrocarbon materials from a subterranean formation containing oil shale, wherein such formation is explosively expanded for forming a stationary, fragmented permeable body or mass of formation particles containing oil shale within the formation, referred to herein as an in situ oil shale retort. Retorting gases are passed through the fragmented mass to convert kerogen contained in the oil shale to liquid and gaseous products, thereby producing retorted oil shale. One method of supplying hot retorting gases used for converting kerogen contained in the the oil shale, as described in U.S. Pat. No. 3,661,423, includes establishing a combustion zone in the retort and introducing an oxygen-supplying retort inlet mixture into the retort to advance the combustion zone through the fragmented mass. In the combustion zone, oxygen from the retort inlet mixture is depleted by reaction with hot carbonaceous materials to produce heat, combustion gas, and combusted oil shale. By the continued introduction of the retort inlet mixture into the fragmented mass, the combustion zone is advanced through the fragmented mass in the retort.

The combustion gas and the portion of the retort inlet mixture that does not take part in the combustion process pass through the fragmented mass on the advancing side of the combustion zone to heat the oil shale in a retorting zone to a temperature sufficient to produce kerogen decomposition, called "retorting." Such decomposition in the oil shale produces gaseous and liquid products, including gaseous and liquid hydrocarbon products, and a residual solid carbonaceous material.

The liquid products and the gaseous products are cooled by the cooled oil shale fragments in the retort on the advancing side of the retorting zone. The liquid hydrocarbon products, together with water produced in or added to the retort, collect at the bottom of the retort and are withdrawn. An off gas is also withdrawn from the bottom of the retort. Such off gas can include carbon dioxide generated in the combustion zone, gaseous products produced in the retorting zone, carbon dioxide from carbonate decomposition, and any gaseous retort inlet mixture that does not take part in the combustion process. The products of retorting are referred to herein as liquid and gaseous products.

It is desirable to form a fragmented mass having a generally uniformly distributed void fraction, i.e., a fragmented mass of generally uniform permeability, so that oxygen-supplying gas can flow relatively uniformly through the fragmented mass during retorting operations. Techniques used for excavating void spaces in a retorting site and for explosively expanding formation toward the voids can affect the uniformity of particle size and/or permeability of the fragmented mass. A fragmented mass having generally uniform permeability in horizontal planes across the fragmented mass avoids bypassing portions of the fragmented mass by retorting gas, which can occur if there is gas channeling through the fragmented mass owing to non-uniform permeability.

The creation of a fragmented mass of relatively uniform permeability distribution not only prevents the formation of channels which hinder total recovery of shale oil, but it also provides a relatively uniform pressure drop through the entire fragmented mass. In the preparation of a fragmented mass, it is important that formation be fragmented and displaced, rather than simply fractured, in order to form a fragmented mass of generally high permeability. It is also important that the retort contain a substantially uniformly fragmented mass of particles so uniform conversion of kerogen to liquid and gaseous products occurs during retorting. A wide distribution of particle size can adversely affect the efficiency of retorting because small particles can be completely retorted long before the cores of large particles are completely retorted.

It has been proposed that oil shale be prepared for in situ recovery by first undercutting a portion of the formation to remove from about 5% to about 25% of the total volume of the in situ retort being formed. The overlying formation is then expanded by detonating explosives placed in the formation to fill the void space created by the undercut.

The general art of blasting rock formations is discussed in *The Blaster's Handbook,* 15th Edition, published by E. I. DuPont de Nemours & Company, Wilmington, Delaware.

Another method for preparing oil shale formation for in situ recovery is described in U.S. Pat. Nos. 4,043,597, and 4,043,598, where two voids vertically spaced apart from each other are excavated in a subterranean formation. This leaves a zone of unfragmented formation between the voids. Vertical blasting holes are drilled in the intervening zone. Explosive is placed in the blasting holes and detonated to expand formation in the intervening zone toward both voids.

SUMMARY OF THE INVENTION

The present invention provides a method for forming an in situ oil shale retort containing a fragmented permeable mass of formation particles containing oil shale. The fragmented mass is formed by excavating a portion of the formation from within a retort site for forming at least a pair of spaced-apart voids, leaving an intervening zone of unfragmented formation between the voids. The intervening zone has substantially parallel free faces adjoining the voids. At least one pancake-shaped load of explosive is placed in the intervening zone. Such a load has faces which are substantially parallel to the free faces adjoining the voids, and the length of the axis of such load is less than the radius of such load. Such load of explosive is detonated for explosively expanding formation in the intervening zone toward both free faces for forming a fragmented mass.

In one form of the invention, formation within the retort site is excavated for forming vertically spaced-apart upper and lower voids providing upper and lower horizontal free faces adjacent the intervening zone. In this embodiment, such explosive load is placed approximately at the vertical center of mass of the intervening zone.

In one embodiment, a plurality of horizontally spaced-apart pancake-shaped explosive loads are placed within the intervening zone. The explosive loads are horizontally spaced apart across a plane at or near the vertical center of mass of the intervening zone. The explosive loads are detonated in a single round of explosions for forming a fragmented mass.

DRAWINGS

These and other aspects of the invention will be more fully understood by referring to the following detailed description and the accompanying drawings, in which.

DETAILED DESCRIPTION

Figure 2:
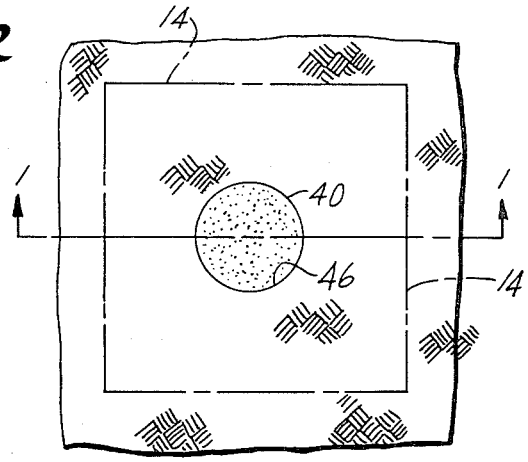
FIG. 2 is a fragmentary, semi-schematic horizontal cross-sectional view taken on line 2—2 of FIG. 1.
Figure 1:
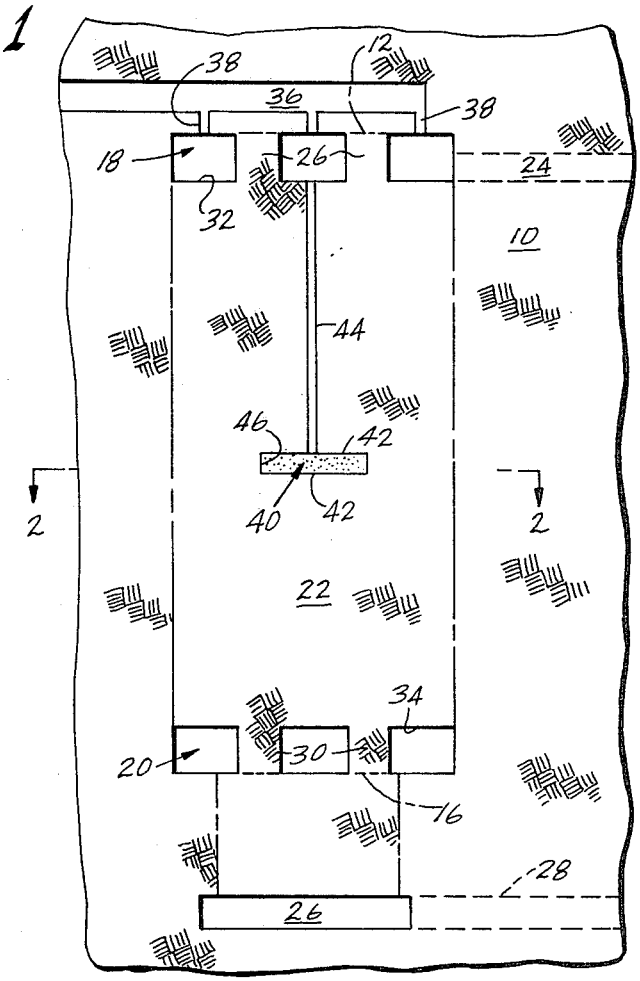
FIG. 1 is a fragmentary, semi-schematic vertical cross-sectional view taken on line 1—1 of FIG. 2 and showing a subterranean formation containing oil shale prepared for explosive expansion according to principles of this invention.

As illustrated in FIGS. 1 and 2, the in situ retort is being formed in a subterranean formation 10 containing oil shale. Such an in situ retort can be round or rectangular in cross-section or can be square as shown in FIGS. 1 and 2. The retort has a top boundary 12, four vertically extending side boundaries 14 and a lower boundary 16.

The in situ retort is formed by excavating formation from within the retort site for forming a plurality of horizontally extending voids. In the illustrated embodiment formation is excavated to form an upper void 18 extending horizontally across an upper level of the retort site and a lower void 20 extending horizontally across a lower level of the retort site, leaving an intervening zone 22 of unfragmented formation within the retort site between the upper and lower voids. The upper void is of generally uniform height across the width of the retort, and the upper void is excavated by access provided by an upper level access drift 24 excavated on the same level as the floor of the upper void. The horizontal cross-section of the upper level void substantially matches the horizontal cross-section of the retort being formed. The upper level void has a sufficient cross-sectional area to provide effective access to substantially the entire horizontal cross-sectional area of the retort being formed. Thus, the upper level void provides an upper level base of operation for use in placement of explosive loading in the intervening zone 22 according to principles of this invention.

In excavating the upper void, a pair of horizontally spaced-apart upper level pillars 26 of unfragmented formation can, if desired, be left within the upper void for providing temporary roof support. Each such support pillar comprises a column of unfragmented formation integral with and extending between the roof and the floor of the void. In the embodiment shown, the pillars in the upper void are horizontally spaced apart and parallel to one another. The pillars are preferably long and narrow, and preferably extend for most of the length of the upper void. In the illustrated embodiment each pillar is similar to a peninsula with one end of the pillar being integral with a side wall of formation adjacent the upper void, forming a generally E-shaped upper void. Other arrangements of pillars can be used if needed or desired.

The lower void 20 has substantially the same horizontal cross-section as the upper void and therefore substantially matches the horizontal cross-section of the retort being formed. A lower level access drift 28 extends horizontally through formation on a lower production level spaced below the bottom boundary of the retort being formed. A production level stub drift 26 is excavated perpendicularly away from a side of the production level drift 28 and extends below the retort being formed for collecting liquid and gaseous products of retorting produced during production of the retort being formed. These liquid and gaseous products are conveyed to the production level drift 28. A pair of horizontally spaced-apart pillars 30 of unfragmented formation can be left within the lower void, if desired, for providing temporary roof support for the intervening zone 22 of unfragmented formation.

The lower void is excavated so that the side boundaries of the upper void and of the lower void lie substantially in common vertical planes. In the illustrated embodiment in FIGS. 1 and 2, the intervening zone 22 is approximately square in horizontal cross-section, and the intervening zone of unfragmented formation extends between a horizontal upper free face 32 of formation adjacent the upper void and a horizontal lower free face 34 of formation adjacent the lower void. The upper and lower free faces are substantially parallel to one another. Additional horizontally extending voids can be excavated, if desired, with a zone of unfragmented formation between each adjacent pair of voids. For purposes of exposition, description of an embodiment with a pair of voids and one intervening zone of unfragmented formation is sufficient.

Figure 5:
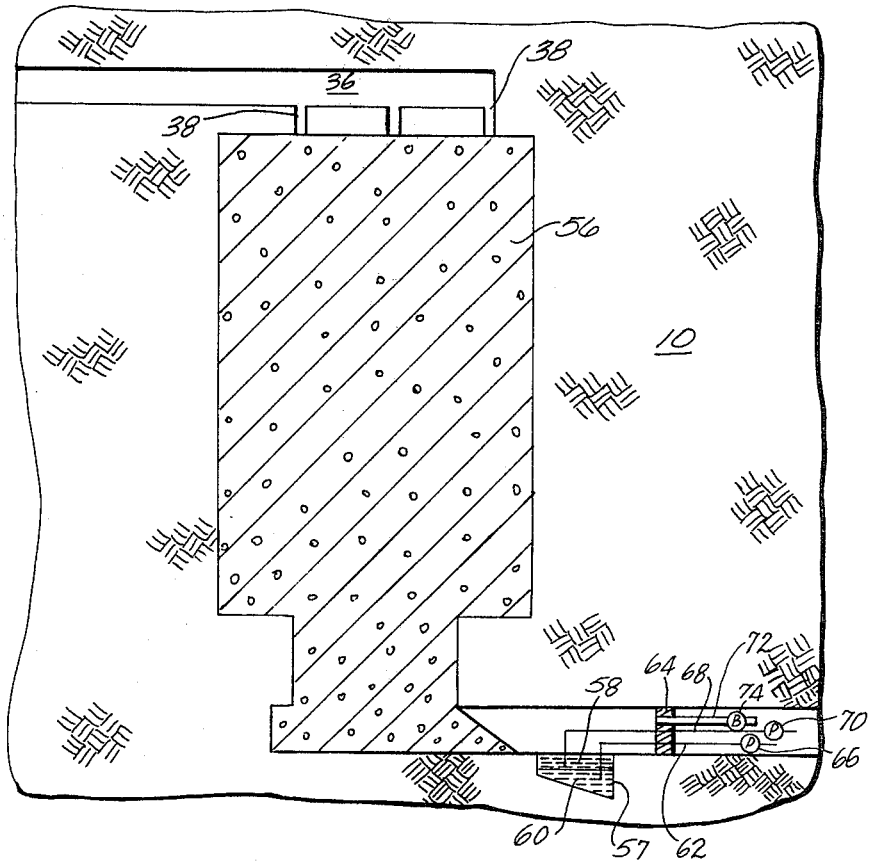
FIG. 5 is a fragmentary, semi-schematic vertical cross-sectional view showing a completed in situ retort formed according to principles of this invention.

The intervening zone is subsequently explosively expanded toward the upper and lower voids for forming a fragmented permeable mass 56 (see FIG. 5) of formation particles containing oil shale in an in situ oil shale retort. Formation within the intervening zone is explosively expanded into a limited void volume provided by the upper and lower voids. By "limited void volume" is meant that the combined volume of the upper and lower voids is smaller than the volume required for free expansion of oil shale formation toward the upper and lower voids. The upper and lower voids occupy from about 15% to about 25% of the total volume within the boundaries of the retort site. With a void volume of about 25% or less, explosive expansion of the intervening zone is into a limited void volume.

An air level drift 36 is excavated on a level spaced above the top of the upper void. The air level drift extends centrally over the upper void, and a plurality of vertical air flow passages 38 are spaced horizontally along the length of the air level drift. The air flow passages extend downwardly from the drift through the roof of the upper void to provide gas communication between the drift and the top of the retort.

Figure 4:
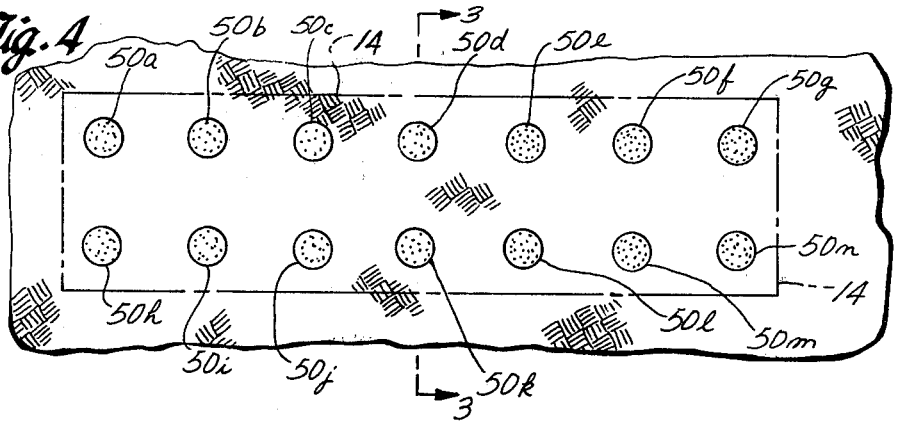
FIG. 4 is a fragmentary, semi-schematic horizontal cross-sectional view taken on line 4—4 of FIG. 3.
Figure 3:
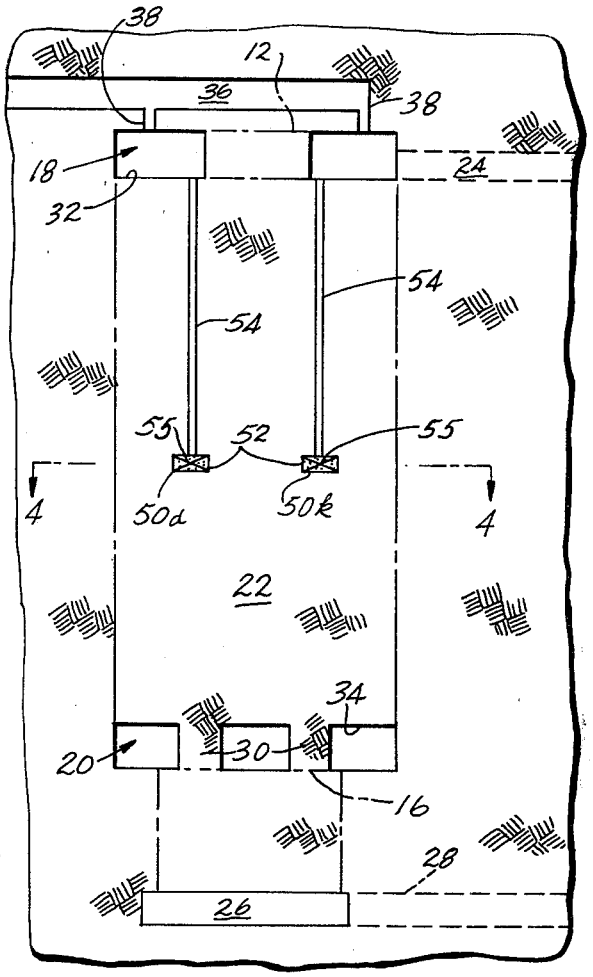
FIG. 3 is a fragmentary, semi-schematic vertical cross-sectional view taken on line 3—3 of FIG. 4 and showing an alternative method for preparing formation containing oil shale for explosive expansion according to principles of this invention.

After formation within the retort site has been excavated as described above, the intervening zone 22 of unfragmented formation is prepared for explosive expansion and subsequent retorting operations. At least one pancake-shaped explosive load 40 is placed in the intervening zone, and thereafter the load is detonated for explosively expanding formation in the intervening zone upwardly and downwardly toward the upper free face 32 and the lower free face 34. Such a pancake-shaped explosive load is generally planar, having generally flat upper and lower faces 42 which are substantially parallel to the upper and lower free faces adjacent the upper and lower voids, respectively. The horizontal dimension of the explosive load is substantially greater than its vertical dimension. In the embodiment illustrated in FIGS. 1 and 2, a single pancake-shaped explosive load is placed in the intervening zone 22. In the embodiments of FIGS. 3 and 4, a plurality of pancake-shaped explosive loads smaller than the single load are placed in the intervening zone.

Referring to the embodiment of FIGS. 1 and 2, the single explosive load is placed in the intervening zone by drilling a vertical bore hole 44 downwardly from the upper void. The vertical bore hole is drilled along a central axis of the retort being formed, and the bore hole is drilled perpendicularly to the upper and lower free faces. In one embodiment, the pancake-shaped explosive load is placed in a pancake-shaped explosive chamber 46 formed at the bottom of the bore hole at about the midpoint of the intervening zone. The explosive chamber is formed on a horizontal plane at or near the vertical center of mass of the intervening zone 22. The explosive chamber is preferably placed slightly above the vertical center of mass of the retort, i.e., somewhat closer to the upper free face than to the lower free face, to compensate for the effect of gravity during subsequent blasting. That is, owing to the influence of gravity, a slightly lower amount of formation is explosively expanded upwardly toward the upper free face than the amount explosively expanded downwardly toward the lower free face.

The explosive chamber is formed by excavating formation at the bottom of the bore hole to form a generally cylindrical chamber in which the length of the vertical axis of the chamber is less than the radius of the chamber. The explosive chamber is formed so that its upper and lower faces 42 are generally parallel to one another as well as being generally parallel to the upper and lower free faces.

The explosive chamber can be formed by various excavating techniques. One method can involve use of a high pressure water jet nozzle (not shown) lowered down the bore hole 44. The water jet nozzle can have a variable angle for swiveling the jet about the axis of the bore hole for eroding away formation to form the cylindrical chamber around the axis of the bore hole. A knuckle joint can be used to extend the water jet nozzle outwardly away from the vertical axis through the bore hole. A vertical drain hole (not shown) also can be drilled down from the explosive chamber through the roof above the lower void for washing out fine particles from the explosive chamber. A water circulation system also can be used for circulating excavated formation particles upwardly through the vertical bore hole 44 and into the base of operation provided by the upper void 18.

As an alternate technique for excavating the explosive chamber, an extensible arm mining tool (not shown) can be lowered down the bore hole to initially excavate a cylindrical hole approximately five to ten feet in diameter and a small continuous mechanical miner (not shown) then can be lowered down the bore hole and used to excavate the remainder of the explosive chamber.

As a further method for forming the explosive chamber, the vertical bore hole can be a four-foot diameter raise, and a workman can be lowered down the raise to manually mine out the explosive chamber.

An advantage of the illustrated embodiment is that the explosive chamber can be formed primarily or entirely by mechanical mining techniques, thereby avoiding appreciable use of explosives.

The desired dimensions of the pancake-shaped explosive chamber vary according to the type of explosive used. That is, the volume of the chamber can be proportionately smaller for proportionately more powerful explosives. Table 1 below shows examples of the size of the chamber as it relates to the type of explosive used.

In one embodiment (not shown), a circular side wall of the explosive chamber can be tapered upwardly and inwardly so that the chamber is essentially in the shape of a frustum of a cone. The tapered side wall can have a relatively low base angle of about 30° or less to accommodate the natural angle of repose of some dry explosives loaded into the explosive chamber, if necessary. For free flowing liquid, slurry, or water gel type explosives, the explosive chamber can be cylindrical as shown.

Following formation of the explosive chamber, explosive is loaded into the chamber, and the vertical bore hole is loaded with an inert stemming material such as sand or gravel. The explosive chamber is essentially filled with the explosive, although the volume within the explosive chamber occupied by the explosive can vary somewhat, as long as the explosive load itself is pancake-shaped or generally planar as described above. It is preferable that the chamber be essentially filled to avoid decoupling the explosive from the overlying formation. In the illustrated embodiment, the depth of the explosive charge (i.e., the length of the vertical axis of the charge) is substantially less than the radius of the explosive charge. A preferred minimum limit of the ratio of height to radius of the explosive charge is 1:2. That is, the radius of the explosive charge can be twice the height, or greater. This minimum limit is determined for an explosive having a given powder factor (in pounds of explosive per ton of formation), plus a powder factor margin ensuring sufficient fragmentation for in situ oil shale retorting, wherein the charge is of sufficient thickness that the explosive charge will be capable of detonating and effectively moving the burden toward the upper and lower horizontal free faces. In the embodiment illustrated in FIG. 1, wherein the explosive chamber is essentially filled with explosive, the height of the explosive chamber is less than the radius of the explosive chamber, and a preferred minimum height to radius ratio is about 1:2.

FIGS. 3 and 4 illustrate an alternative embodiment for a rectangular retort wherein a plurality of horizontally spaced-apart individual pancake-shaped explosive loads are placed in an intervening zone of unfragmented formation between a pair of horizontally extending voids. In the illustrated embodiment there are fourteen loads 50*a* through 50*n*. The multiple explosive loads are preferably equidistantly spaced apart across the horizontal cross-section of the retort being formed. The multiple explosive loads also are placed in a common horizontal plane preferably at or slightly above the vertical center of mass of the intervening zone 22. The plane of each explosive load is generally parallel to the upper and lower free faces. The multiple explosive loads are individually smaller than the single explosive load 40 illustrated in the embodiment of FIGS. 1 and 2. Preferably, the combined powder factor of the multiple explosive loads is substantially equal to the powder factor equal to the weight of the large single explosive load, for a same type of explosive agent.

The pancake-shaped explosive charge being generally parallel to the upper and lower free faces facilitates effective fragmentation of oil shale formation for a given weight of explosive. The pancake-shaped explosive charges can perform effectively as long as the smallest dimension of each explosive charge is five inches or more for the preferred aluminized slurry explosive and nine inches or more for ANFO or the nonaluminized explosive described above. Stated another way, each pancake-shaped explosive charge has a depth of at least about five inches when the explosive load is an explosive slurry or water gel, and each explosive has a thickness or height of at least about nine inches when the explosive load is a dry blasting agent.

In the fourteen-charge arrangement illustrated in FIGS. 3 and 4, the explosive charges are placed in a rectangular pattern of two equidistantly spaced apart rows with seven explosive charges per row. The explosive charges in each row are equidistantly spaced apart from one another, at the same distance as the spacing between rows. This pattern of explosive placement is illustrated best in FIG. 4.

The multiple explosive charges preferably are placed in the intervening zone by initially forming separate smaller explosive chambers 52 by an excavation technique similar to the techniques suitable for excavating the single explosive chamber described above. That is, each smaller explosive chamber is formed by first drilling a separate horizontally spaced apart vertical bore hole 54 downwardly from the upper void to about the middle of the intervening zone, and then reaming out the bottom of each bore hole to form each explosive chamber. The individual smaller explosive chambers all have the same shape as the single larger explosive chamber, in that each of the individual chambers is generally cylindrical in shape with the depth of the chamber being substantially less than the radius of the chamber. The top and bottom faces of each smaller explosive chamber are generally parallel to the upper and lower free faces, respectively. In an alternate embodiment, the side wall of each explosive chamber can be tapered so the chamber is shaped as a frustum of a cone for accommodating the angle of repose of a dry explosive charge, as described above for the single explosive chamber.

The individual smaller explosive chambers 52 are loaded with separate explosive charges, and the separate bore holes 54 are stemmed. The explosive used in either the single explosive charge embodiment or the fourteen-charge embodiment preferably is a pumped-in slurry-type or water gel explosive for minimizing formation of voids within the explosive charge. An exemplary explosive is an aluminized slurry having a density of about 1.2 g/cc and a maximum available energy, A, of about 900 kcal/kg. Nonaluminized explosive slurries also can be used. In one embodiment, a nonaluminized slurry having a density of about 1.05 g/cc with an energy, A, of about 750 kcal/kg can be used. However, approximately 20% more of this explosive is required than the aluminized slurry.

As a further alternative, ammonium nitrate-fuel oil (ANFO) can provide a satisfactory explosive if the explosive chambers are essentially free of water.

Charge sizes, and chamber volumes, diameters and heights for an aluminized slurry, a nonaluminized slurry, and ANFO explosive agents for an exemplary retort where the intervening zone contains 188,229 tons of unfragmented formation are set forth in Table 1 below. Two examples are given, one for a single pancake-shaped load and one for a nine-pancake pattern.

Following explosive loading of either the one-charge embodiment or a multiple-charge embodiment, explosive placed in the intervening zone is detonated for explosively expanding unfragmented formation within the zone upwardly and downwardly toward the upper and lower horizontal free faces, respectively. This forms a fragmented permeable mass 56 (see FIG. 5) of formation particles containing oil shale in an in situ oil shale retort. The individual explosive charges in a multiple-charge embodiment are detonated in a single round of explosions, either simultaneously or by using time delay caps (illustrated at 55 in FIG. 3), so that the individual charges are detonated consecutively in a time delay sequence. The total time to detonate the single round, i.e., the time required for detonating all the charges, can be, for example, from about 50 to 200 milliseconds. In an embodiment wherein the pillars are temporarily left in the upper and lower voids, the pillars are explosively expanded a short time interval before detonation of explosive in the intervening zone.

The pancake-shaped explosive charges are detonated so that substantially equal amounts of formation are explosively expanded upwardly toward the upper void and downwardly toward the lower void. To accommodate the force of gravity during explosive expansion, the upward burden is preferably somewhat less than the downward burden. Upon explosive expansion toward the upper and lower free faces, the volume initially present in the upper and lower voids becomes dispersed between the particles in the fragmented mass of particles formed within the retort site.

During retorting operations, formation particles at the top of the fragmented mass are ignited to establish a combustion zone at the top of the fragmented mass. Air or other oxygen-supplying gas supplied to the combustion zone from the air level drift 36 through the air passages 38 to the top of the fragmented mass sustains the combustion zone and advances it downwardly through the fragmented mass. Combustion gas produced in the combustion zone passes through the fragmented mass to establish a retorting zone on the advancing side of the combustion zone wherein kerogen in the fragmented mass is converted to liquid and gaseous products. As the retorting zone moves down through the fragmented mass, liquid and gaseous products are released from the fragmented formation particles. A sump 57 in the portion of the production level drift 28 beyond the fragmented mass collects liquid products, namely, shale oil 58 and water 60, produced during operation of the retort. A water withdrawal line 62 extends from near the bottom of the sump out through a sealed opening in a bulkhead 64 sealed across the production level drift. The water withdrawal line is connected to a water pump 66. An oil withdrawal line 68 extends from an intermediate level in the sump out through a sealed opening in the bulkhead and is connected to an oil pump 70. The water and oil pumps can be operated manually or by automatic controls (not shown) to remove shale oil and water separately from the sump. Off gas is withdrawn from behind the bulkhead by an off gas line 72 sealed through the bulkhead and connected to a blower 74.

The invention has been described in the context of the embodiments illustrated in FIGS. 1 to 4, but other patterns of pancake-shaped charges can be used without departing from the scope of the invention. For example, the pancake charges can be placed on a 4-spot or 5-spot pattern in a square, or the size of some pancake charges can differ with respect to others placed in a given retort site. Further, the pancake charges can be used with a mining arrangement having several zones of unfragmented formation within a given retort site.

TABLE 1

Charge Sizes, Chamber Volumes, Diameters, and Heights for Equivalent Cylinders at Average Height/Diameter = 0.2 for Two Slurries and ANFO A. Aluminized Slurry of A = 900 kcal/kg and density = 1.2 g/cc.
Loading factor (pounds of explosive/ton of formation) 1.0

| | One-Hole Pattern | Nine-Hole Pattern |
|---|---|---|
| Hole volume (cubic feet) | 2,510 | 279 |
| Charge per hole (pounds) | 188,229 | 20,914 |
| Hole diameter (feet) | 25.2 | 12.1 |
| Average hole depth (inches) | 60 | 29 |

B. Nonaluminized slurry of A = 750 kcal/kg and density = 1.05 g/cc or equivalent
Loading factor (pounds of explosive/ton of formation) 1.2

| | One-Hole Pattern | Nine-Hole Pattern |
|---|---|---|
| Hole volume (cubic feet) | 3,442 | 282 |
| Charge per hole (pounds) | 225,875 | 25,100 |
| Hole diameter (feet) | 28 | 13.45 |
| Average hole depth (inches) | 67 | 32 |

C. ANFO (A = 800 and density = 1.2)
Loading factor (pounds of explosive/ton of formation) 1.125

| | One-Hole Pattern | Nine-Hole Pattern |
|---|---|---|
| Hole volume (cubic feet) | 4,130 | 460 |
| Charge per hole (pounds) | 211,760 | 23,530 |
| Hole diameter (feet) | 29.7 | 14.3 |
| Average hole depth (inches) | 71 | 34 |

What is claimed is:

1. A method for recovering liquid and gaseous products from an in situ oil shale retort formed in a subterranean formation containing oil shale, the in situ oil shale retort containing a fragmented permeable mass of formation particles containing oil shale, the method comprising the steps of:

excavating an upper void and a lower void vertically spaced apart from each other in the subterranean formation, at least a portion of the upper void being substantially directly above the lower void, thereby leaving an intervening zone of unfragmented formation between the voids, the intervening zone having an upper horizontal free face adjacent the upper void and a lower horizontal free face adjacent the lower void;

preparing at least one generally cylindrical explosive chamber in the intervening zone between the excavated voids, the axis of such an explosive chamber being substantially perpendicular to the free faces, the length of the axis of such explosive chamber being less than the radius of such explosive chamber;

placing a load of explosive in such explosive chamber;

detonating the load of explosive in such explosive chamber for explosively expanding formation in the intervening zone toward both voids at the same time to produce a fragmented permeable mass of formation particles containing oil shale in an in situ oil shale retort;

introducing an oxygen-supplying gas to the fragmented mass for sustaining a retorting zone in the fragmented mass and for advancing the retorting zone through the fragmented mass; and recovering liquid and gaseous products of retorting from a lower portion of the in situ oil shale retort.

2. The method of claim 1 including placing a free flowing explosive in the explosive chamber.

3. The method of claim 1 including placing a dry explosive in the explosive chamber.

4. The method of claim 1 in which the explosive chamber is prepared by the steps of:

drilling a substantially vertical access hole in the intervening zone;

placing excavating means in the access hole; and excavating the explosive chamber with the excavating means.

5. The method of claim 1 in which the ratio of the length of the axis of the explosive chamber to the radius of the explosive chamber is at least about 1:2.

6. A method for forming an in situ oil shale retort in a subterranean formation containing oil shale, the in situ retort containing a fragmented permeable mass of formation particles containing oil shale, the method comprising the steps of:

excavating within the formation at least a pair of spaced apart voids and leaving an intervening zone of unfragmented formation between such a pair of voids, the intervening zone having substantially parallel free faces adjoining the voids;

placing in such an intervening zone at least one pancake-shaped load of explosive, such an explosive load having faces which are substantially parallel to the free faces, wherein the length of the axis of such load is less than the radius of such load; and detonating such load of explosive for expanding formation in the intervening zone toward both free faces at the same time for forming a fragmented mass of particles in an in situ oil shale retort.

7. The method of claim 6 in which the ratio of the length of the axis of such a load to the radius of such load is at least about 1:2.

8. The method of claim 6 in which the step of placing explosive comprises placing a plurality of such pancake-shaped loads of explosive in such an intervening zone.

9. The method of claim 8 in which the placed loads of explosive are detonated in a single round of explosions.

10. The method of claim 8 in which the free faces are substantially horizontal, and such loads are placed at horizontally spaced-apart locations in the intervening zone at about the vertical center of mass of the intervening zone.

11. The method according to claim 10 in which such explosive loads are placed a short distance above the center of mass of the intervening zone.

12. The method according to claim 8 in which the free faces are substantially horizontal, and such explosive loads are placed at horizontally spaced-apart locations on a common horizontal plane in the intervening zone.

13. A subterranean formation in an intermediate stage of preparation for in situ recovery of constituents from the formation comprising:

a plurality of spaced apart voids in the formation;

an intervening zone of unfragmented formation between a pair of such voids, the intervening zone having substantially parallel free faces adjoining the voids;

at least one pancake-shaped load of explosive in the intervening zone, the faces of such a load being parallel to the free faces of the intervening zone, wherein the length of the axis of such load is substantially less than the radius of such load; and means for detonating such load of explosive for expanding formation in the intervening zone toward both free faces at the same time.

14. The subterranean formation of claim 13 in which the ratio of the length of the axis of such load to the radius of such load is at least about 1:2.

15. The subterranean formation of claim 13 comprising a plurality of such pancake-shaped loads of explosive in the intervening zone.

16. The subterranean formation of claim 15 in which the free faces are substantially horizontal, and such loads are horizontally spaced apart in the intervening zone at about the vertical center of mass of the intervening zone.

17. The subterranean formation of claim 15 comprising means for detonating the loads of explosive in a single round.

18. The subterranean formation of claim 15 in which the pancake-shaped loads of explosive are placed approximately at the center of mass of the intervening zone.

19. A method for forming an in situ oil shale retort in a subterranean formation containing oil shale, the in situ retort containing a fragmented permeable mass of formation particles containing oil shale, and having a top boundary, a bottom boundary, and side boundaries of unfragmented formation, comprising the steps of:

excavating an upper void and a lower void vertically spaced apart from each other within the boundaries of the retort being formed, at least a portion of the upper void being substantially directly above the lower void, thereby leaving an intervening zone of unfragmented formation between the upper and lower voids within the boundaries of the retort being formed, the intervening zone having an upper horizontal free face adjacent the upper void and a lower horizontal free face adjacent the lower void;

drilling at least one substantially vertical access hole in the intervening zone;

placing excavating means in such an access hole;

excavating at least one explosive chamber in the intervening zone with the excavating means;

placing in such an explosive chamber a pancake-shaped load of explosive having faces which are substantially parallel to the free faces of the intervening zone, wherein the length of the axis of the load is less than the radius of the load; and detonating the load of explosive for expanding formation in the intervening zone toward both voids at the same time for forming a fragmented permeable mass of formation particles containing oil shale in an in situ retort.

20. The method of claim 19 in which the ratio of the length of the axis of the load to the radius of the load is at least about 1:2.

21. The method of claim 19 wherein the upper void is adjacent the top boundary, the lower void is adjacent the bottom boundary, and the intervening zone of unfragmented formation is a single zone of formation extending between upper and lower voids.

22. The method of claim 19 including excavating an explosive chamber having a height of at least about 5 inches; and placing a free flowing explosive in the explosive chamber.

23. The method of claim 19 including excavating an explosive chamber having a height of at least about 9 inches and placing a dry explosive in the explosive chamber.

24. The method of claim 19 in which such an explosive chamber is at about the vertical center of mass of the intervening zone.

25. The method of claim 19 in which such an explosive chamber is a short distance above the vertical center of mass of the intervening zone.

26. The method of claim 19 in which the explosive load is placed in the intervening zone so that approximately the same amount of formation is explosively expanded upwardly toward the upper free face that is explosively expanded downwardly toward the lower free face.

27. A subterranean formation containing oil shale in an intermediate stage of preparation for forming an in situ oil shale retort for in situ recovery of shale oil from the formation comprising:

an upper void and a lower void vertically spaced apart from each other in the subterranean formation, at least a portion of the upper void being substantially directly above the lower void;

an intervening zone of unfragmented formation between the upper and lower voids, the intervening zone having a horizontal upper free face adjacent the upper void and a horizontal lower free face adjacent the lower void;

at least one explosive chamber in the intervening zone;

a pancake-shaped load of explosive in such an explosive chamber, the load of explosive having faces which are substantially parallel to the free faces of the intervening zone, wherein the length of the axis of the load is less than the radius of the load; and means for detonating the load of explosive for expanding formation in the intervening zone toward both voids at the same time.

28. The subterranean formation of claim 27 comprising a plurality of pancake-shaped explosive chambers having faces which are substantially parallel to the free faces of the intervening zone located substantially in a plane parallel to the free faces.

29. The subterranean formation of claim 27 in which the ratio of the length of the axis of the load to the radius of the load is at least about 1:2.

30. The subterranean formation of claim 27 in which such an explosive chamber has a height of at least about 5 inches, and the load of explosive in such explosive chamber is a free flowing explosive.

31. The subterranean formation of claim 27 in which such an explosive chamber has a height of at least about 9 inches, and the load of explosive in such explosive chamber is a dry explosive.

32. The subterranean formation of claim 27 in which such an explosive chamber contains such a load of explosive at about the vertical center of mass of the intervening zone.

33. The subterranean formation of claim 27 in which such an explosive chamber contains such a load of explosive above the vertical center of mass of the intervening zone.

34. A method for forming an in situ oil shale retort in a subterranean formation containing oil shale, the in situ retort containing a fragmented permeable mass of formation particles containing oil shale, the method comprising the steps of:

excavating at least an upper void and a lower void vertically spaced apart from each other in the subterranean formation, at least a portion of the upper void being substantially directly above the lower void, thereby leaving an intervening zone of unfragmented formation between the upper and lower voids, the intervening zone having a horizontal upper free face adjacent the upper void and a horizontal lower free face adjacent the lower void;

placing in the intervening zone a plurality of pancake-shaped loads of explosive, each load having faces which are substantially parallel to the free faces of the intervening zone, wherein the length of the axis of each such pancake-shaped load is less than the radius of the load; and detonating the pancake-shaped loads of explosive in a single round of explosions for expanding formation in the intervening zone toward both voids at substantially the same time.

35. The method of claim 34 in which the pancake-shaped loads of explosive are horizontally spaced apart at substantially the same elevation in the intervening zone.

36. The method of claim 34 in which the pancake-shaped loads of explosive are horizontally spaced apart at or slightly above the vertical center of mass of the intervening zone.

37. The method according to claim 34 in which each explosive load has a depth to radius ratio of at least about 1:2.

38. A subterranean formation containing oil shale in an intermediate stage of preparation for in situ recovery of shale oil from the formation comprising:

an upper void and a lower void vertically spaced apart from each other in the subterranean formation, at least a portion of the upper void being substantially directly above the lower void;

an intervening zone of unfragmented formation between the voids, the intervening zone having a horizontal upper free face adjacent the upper void and a horizontal lower free face adjacent the lower void;

a plurality of pancake-shaped loads of explosive having faces which are substantially parallel to the free faces of the intervening zone, wherein the length of the axis of each such pancake-shaped load is less than the radius of the load; and means for detonating the pancake-shaped loads of explosives in a single round for expanding formation in the intervening zone toward both voids at the same time.

39. The subterranean formation of claim 38 in which the pancake-shaped loads of explosive are horizontally spaced apart at substantially the same elevation in the intervening zone.

40. The subterranean formation of claim 38 in which the pancake-shaped loads of explosive are horizontally spaced apart at or slightly above the vertical center of mass of the intervening zone.

41. The subterranean formation of claim 38 in which such pancake-shaped loads of explosive have a depth to radius ratio of at least about 1:2.

* * * * *